US006253742B1

(12) United States Patent
Wickman et al.

(10) Patent No.: US 6,253,742 B1
(45) Date of Patent: Jul. 3, 2001

(54) FUEL SUPPLY METHOD FOR A MARINE PROPULSION ENGINE

(75) Inventors: Timothy P. Wickman, Fond du Lac; Douglas E. Trombley, Oshkosh; Erivn H. Voss, Jr., Princeton, all of WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/550,720

(22) Filed: Apr. 17, 2000

(51) Int. Cl.[7] ..... F02M 33/04
(52) U.S. Cl. ..... 123/516; 123/497
(58) Field of Search ..... 123/516, 497, 123/494

(56) References Cited

U.S. PATENT DOCUMENTS 4,809,666 3/1989 Baltz ..... 123/516
5,417,239 * 5/1995 Ford ..... 137/571
5,477,833 * 12/1995 Leighton ..... 123/497
5,913,294 * 6/1999 Takahashi et al. ..... 123/516

FOREIGN PATENT DOCUMENTS 197 10 299 A1 * 1/1998 (DE) .

* cited by examiner

*Primary Examiner*—Thomas N. Moulis
(74) *Attorney, Agent, or Firm*—William D. Lanyi

(57) ABSTRACT

A method for controlling the operation of a fuel system of an outboard motor uses a lift pump to transfer fuel from a remote tank to a vapor separator tank. Only one level sensor is provided in the vapor separator tank and an engine control unit monitors the total fuel usage subsequent to the most recent filling of the tank. When the fuel usage indicates that the fuel level in the vapor separator tank has reached a predefined lower level, a lift pump is activated to draw fuel from a remote tank and provide that fuel to the vapor separator tank.

17 Claims, 3 Drawing Sheets

FUEL SUPPLY METHOD FOR A MARINE PROPULSION ENGINE

BACKGROUND OF THE INVENTION

1. Field of the Invention

The present invention is generally related to a fuel supply system for a marine propulsion device and, more particularly, to a method by which an intermediate holding tank is replenished with fuel based on the consumption of fuel from the intermediate holding tank as determined by the amount of fuel provided to a plurality of fuel injectors.

2. Description of the Prior Art

Many different types of fuel supply systems are known to those skilled in the art. In certain fuel systems, a vapor separator tank (VST) is provided as an intermediate holding tank from which fuel is pumped to the injectors of a fuel injected engine. Another pump, generally referred to as a lift pump, can also be provided to transfer fuel from an external tank to the vapor separator tank.

U.S. Pat. No. 4,809,666, which issued to Baltz on Mar. 7, 1989, describes a fuel feed system for supplying fuel to a combustion chamber of a first internal combustion engine and to a combustion chamber of a second internal combustion engine. The fuel feed system includes a fuel tank, a first fuel pump including an outlet, and an inlet communicating with the fuel tank. The system also includes a fuel vapor separator including a first outlet, a second outlet, and an inlet communicating with the first fuel pump outlet, a second fuel pump communicating with the fuel vapor separator first outlet and communicating with the first engine combustion chamber, and a third fuel pump communicating with the fuel vapor separator second outlet and communicating with the second engine combustion chamber.

U.S. Pat. No. 5,417,239, which issued to Ford on May 23, 1995, describes a fuel transfer control apparatus. The apparatus is used for automatically shutting off the transfer of fuel from an auxiliary tank to a main fuel tank in a motor vehicle having an auxiliary fuel tank, a main fuel tank including a receptacle for receiving fuel from an outside source, a conduit for receiving fuel from the auxiliary tank and an activating means for transferring fuel from the auxiliary tank to the main tank. The apparatus comprises a chamber having opposite ends and being positioned to receive fuel overflow from the main tank. It also comprises an inlet opening at one end of the chamber for receiving the fuel overflow into the chamber from the main fuel tank. In addition, it comprises a sensor in the chamber for sensing the level of fuel in the chamber and a switch operable between on and off positions and connected to and responsive to the sensor wherein the activating means is automatically turned off when the switch is moved to the on position for stopping the transfer of fuel.

U.S. Pat. No. 5,913,294, which issued to Takahashi et al on Jun. 22, 1999, describes an outboard motor fuel supply system. The outboard motor includes a simply structured fuel supply system of a smaller size and a longer life than prior fuel supply systems. The fuel supply system includes a delivery fuel tank carried by the outboard motor. The fuel is pumped from an external fuel supply tank carried by the watercraft to the delivery fuel tank by a low pressure fuel pump located within the outboard motor. The control system controls the low pressure fuel pump so that a predetermined level of fuel is maintained in the delivery fuel tank. The control system includes a fuel level detection sensor that detects the level of fuel within the delivery fuel tank and produces a corresponding signal indicative of the fuel level.

A control unit circuit receives the fuel level signal and determines if the fuel level in the tank is higher or lower than a predetermined maximum fuel level. If the fuel level is determined to be higher than a maximum fuel level, the control unit circuit deactivates the low pressure fuel pump. If the fuel level is determined to be lower than the maximum fuel level, the control circuit activates the low pressure fuel pump.

SUMMARY OF THE INVENTION

A method for controlling the level of a liquid in a tank, made in accordance with the present invention, comprises the steps of providing a liquid level sensor which provides a signal when the liquid is at a first predetermined level within the tank, measuring a quantity of the liquid removed from the tank subsequent to the liquid level sensor providing the signal that the liquid was at the first predetermined level, and comparing the quantity to a predefined magnitude. It also comprises the steps of causing a flow of the liquid into the tank from an external source when the quantity exceeds or equals the predefined magnitude and then terminating the causing step when the liquid level sensor provides the signal when the liquid is at the first predefined level.

In a particularly preferred embodiment of the present invention, the liquid is fuel for an internal combustion engine and the tank is a vapor separator tank (VST) used in conjunction with an outboard motor. The tank can be disposed under a cowl of the outboard motor. Alternatively, the vapor separator tank can be mounted on the external surface of the drive shaft housing. In a preferred embodiment of the present invention, the signal from the liquid level sensor is a binary signal and the quantity measuring step comprises the step of counting a number of fuel injection operations that have occurred since the last occurrence of the signal. Alternatively, the quantity measuring step can comprise the step of accumulating the total volume of the liquid injected by all of the fuel injectors since the last occurrence of the signal.

In certain embodiments of the present invention, the method can further comprise the step of filling the tank from an external source when the ignition system of the outboard motor is initially operated following a period of inactivity. It can also comprise the steps of measuring a usage of an electrical current by a pump used to perform the causing step and transmitting an alarm signal when the usage of electrical current falls below a predefined magnitude while the pump is operating.

BRIEF DESCRIPTION OF THE DRAWINGS

The present invention will be more fully and completely understood from a reading of the description of the preferred embodiment in conjunction with the figures, in which.

DESCRIPTION OF THE PREFERRED EMBODIMENT

Figure 1:
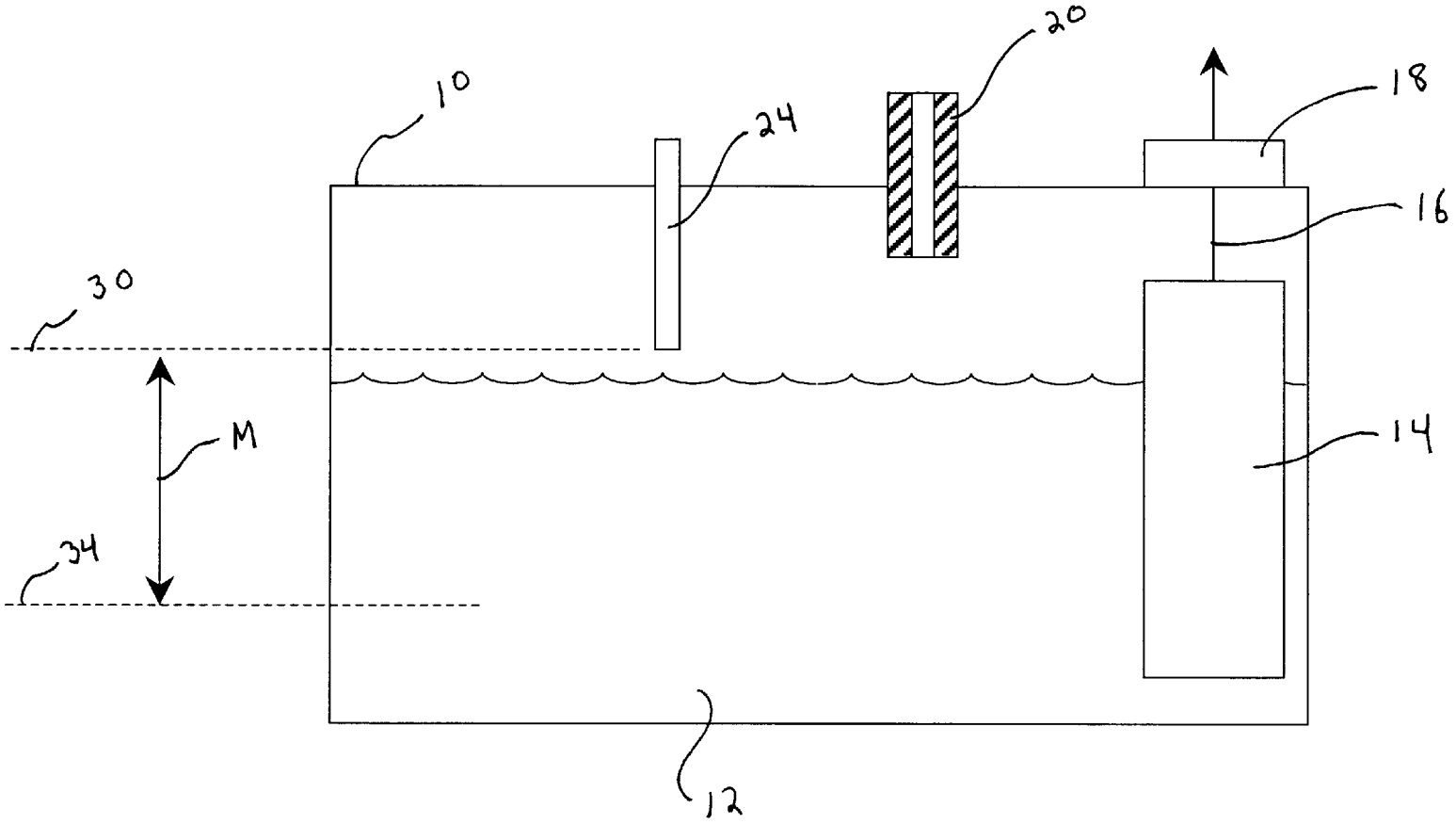
FIG. 1 shows a vapor separator tank, a liquid level sensor, and two target levels of fuel within the tank.

Throughout the description of the preferred embodiment, like components will be identified by like reference numerals.

FIG. 1 shows a tank 10 in which a quantity of liquid 12, such as fuel, is stored for use by an internal combustion engine. A high pressure pump 14 draws fuel from the tank 10 and pumps the fuel to a fuel injection system, as indicated by arrow 16 which also schematically shows the fuel passing through a pressure regulator 18.

The tank 10 can be a vapor separator tank (VST) of an outboard motor. Typically, the tank 10 is provided with a vent 20 to allow vapor to escape from the tank 10. A liquid level sensor 24 provides a signal when the level of liquid 12 in the tank 10 reaches the level represented by dashed line 30. In a preferred embodiment of the present invention, the signal provided by the liquid level sensor 24 is binary in nature and represents information relating to whether or not the liquid 12 is at or above level 30.

With continued reference to FIG. 1, dimension M represents a predefined magnitude of liquid in the tank 10 that is used by the present invention to determine whether or not more liquid should be provided to the tank 10. The predefined magnitude M of fuel 12 is represented as a fuel level dimension, or height, between dashed lines 30 and 34, but it should be realized that this linear dimension can easily be compared mathematically to a volume of liquid required to replenish the level in the tank 10 from that represented by dashed line 34 to that represented by dashed line 30.

Figure 2:
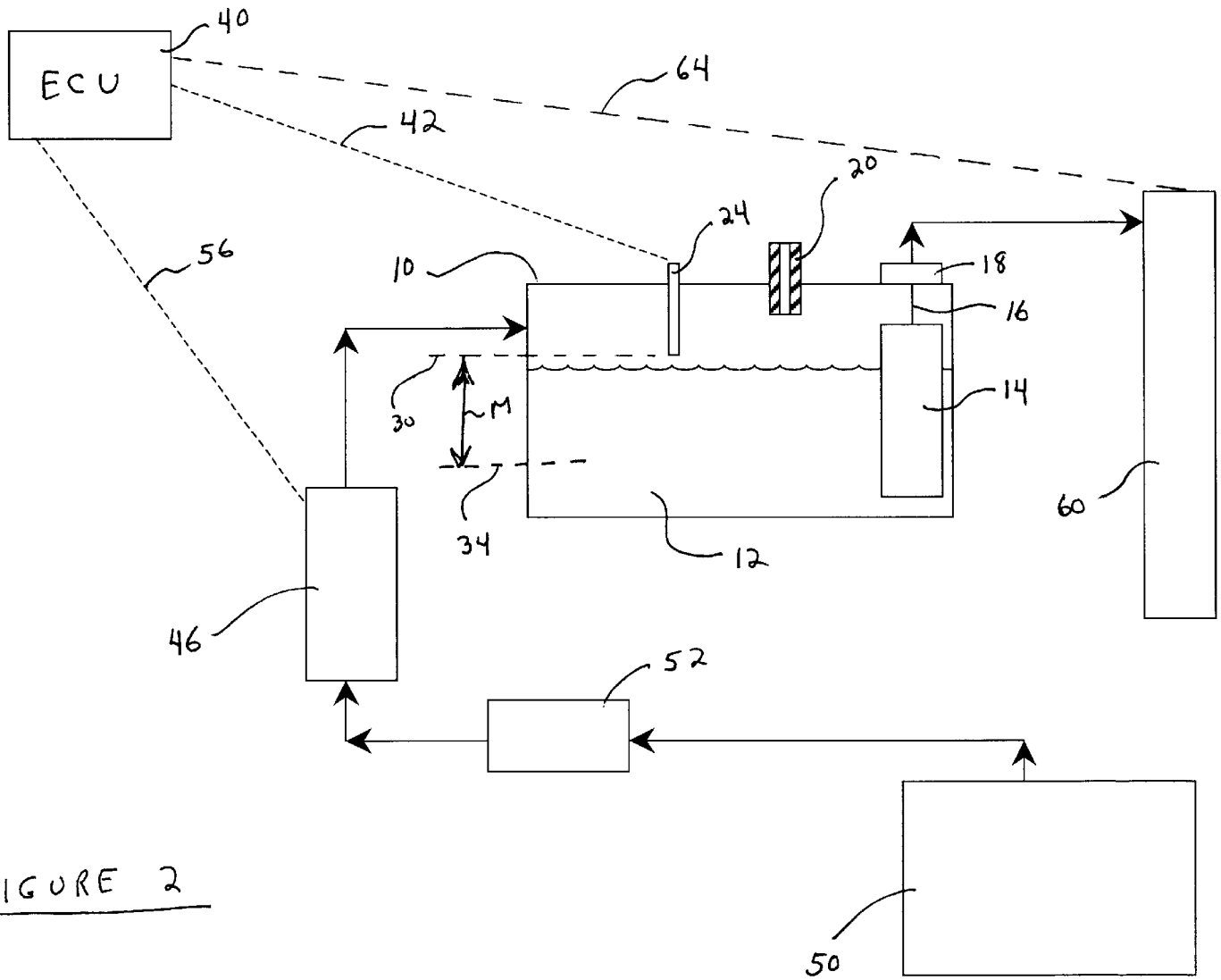
FIG. 2 shows the vapor separator tank of FIG. 1 in combination with other components of a fuel control system.

FIG. 2 shows the tank 10 associated with other components of a fuel supply system for an internal combustion engine. An engine control unit (ECU) 40 receives a signal on dashed line 42 from the liquid level sensor 24. The signal on line 42 represents the fact that the liquid level has achieved the height of at least the sensing position of the liquid level sensor 24, as represented by dashed line 30. The system is provided with a lift pump 46 that is connected in fluid communication with an external fuel source 50, such as a portable gasoline tank commonly used in conjunction with outboard motors. A filter 52 can also be provided to filter the fuel passing from the external tank 50 through the lift pump 46 and into the tank 10. The ECU 40 provides a signal, on dashed line 56, to activate or deactivate the lift pump 46, which is an electric pump in a preferred embodiment of the present invention. The lift pump 46 is activated until the fuel level rises to that represented by dashed line 30 which, because of the nature of the liquid level sensor 24, causes a binary signal to be transmitted on line 42 to the engine control unit 40. It should be noted that no sensor is used to detect when the level of the fuel 12 falls to that represented by dashed line 34. Instead, the engine control unit 40 monitors the usage of fuel by the engine and compares that accumulated fuel usage to the magnitude represented by arrow M in FIG. 2.

With continued reference to FIG. 2, the fuel injection system 60 represents the combination of one or more fuel rails and a plurality of fuel injectors, which is determined by the number of cylinders in the engine. The operation of the fuel injectors is controlled by the engine control unit 40, as represented by dashed line 64. In a particularly preferred embodiment of the present invention, the engine control unit 40 controls the amount of fuel injected by each injector during each cycle of the engine. This allows the engine control unit 40 to monitor the fuel usage by accumulated the total number of injections and the amount of fuel injected into the cylinders during each cycle of each injector. Over time, the engine control unit 40 can determine the total fuel used and compare it to the amount of fuel contained between dashed lines 30 and 34. When that fuel consumption is eventually reached, the engine control unit 40 activates the lift pump 46 to draw fuel from the remote tank 50 and raise the level of fuel 12 within tank 10 to that indicated by dashed line 30, at which time a binary signal is again provided by the sensor 24 on dashed line 42 to the engine control unit 40. When the signal is received on line 42, the engine control unit 40 deactivates the lift pump 46.

Figure 3:
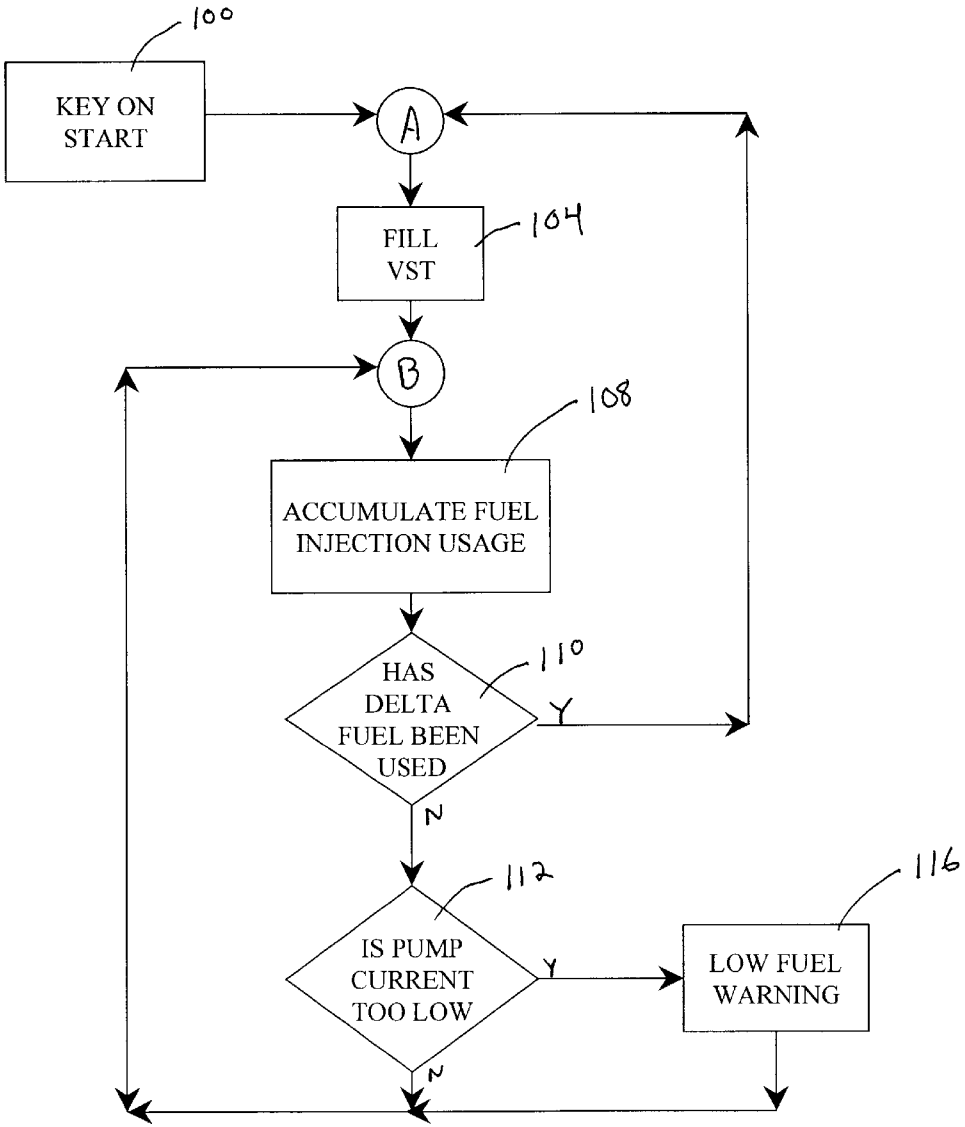
FIG. 3 is a schematic flow chart of the operation of the present invention.

FIG. 3 is a simplified flow chart describing the basic algorithm used to perform the method of the present invention. Functional block 100 represents the initial activation of the internal combustion engine. This typically occurs when the vessel operator turns the ignition key. Proceeding to node A, the engine control unit fills the vapor separator tank 10 as represented by functional block 104. This involves the steps of activating the lift pump 46 as described above in FIG. 2, and monitoring the signal on line 42 from the level sensor 24. The lift pump 46 remains activated until the signal is received on line 42. At that point, the engine control unit 40 recognizes the fact that the fuel 12 is at the level represented by dashed line 30 in FIG. 2 and, as a result, deactivates the lift pump 46. These steps occur each time functional block 104 is performed. It should be noted that activation of functional block 104 in FIG. 3 is not dependent on a particular level of fuel 12 within tank 10. For example, when the engine is initially started, the fuel level within tank 10 may be significantly above that represented by dashed line 34. However, since the period of inactivity prior to the key start is generally unknown and potential evaporation of the fuel 12 can not be determined accurately, the tank 10 is filled upon each new initialization of the engine's operation as represented by functional block 104. It should be understood that the tank filling step of functional block 104 could also include the step of timing the filling procedure. For example, if the pump 36 is activated for a period of time exceeding an upper limit and sensor 24 has not provided a signal on line 42 to the engine control unit 40, the engine control unit can recognize that a possible failure of the sensor 24 has occurred. It can be empirically determined what the maximum necessary time is to fill the vapor separator tank up to the level represented by dashed line 30 and, if this time period is exceeded, the engine control unit can stop the filling process and create an alarm condition to notify the marine vessel operator of this likely failure. Although not a required element in all embodiments of the present invention, this timing feature can easily be included to avoid possibly overfilling the vapor separator tank. Following node B, the engine control unit 40 accumulates the fuel usage of the engine. This can be done in two basic ways. First, the preferred operation is for the engine control unit 40 to continually monitor the amount of fuel each fuel injector injects into its associated cylinder during each cycle of the engine. These individual quantities of fuel are accumulated by the engine control unit 40 and a total value of this increasing volume is maintained during the operation of the engine. When this total value, which represents accumulated fuel usage since the most recent filling of the tank 10, is equal to or greater than that which is equivalent to the predefined magnitude M shown in FIG. 2, the engine control unit 40 determines that it is again time to fill the tank 10. The accumulation of the fuel usage, as described above, is represented by functional block 108 in FIG. 3. Functional block 110 in FIG. 3 represents the decision that is made to determine whether or not the "Delta" amount of fuel represented by the predefined magnitude M in FIG. 2 has been used. If the predefined magnitude has been used, the algorithm proceeds to node A and the vapor separator tank 10 is again filled as represented by functional block 104. If the predefined magnitude has not been used, the accumulating and monitoring cycle is repeated.

In one particular embodiment of the present invention, the engine control unit 40 compares the current magnitude of lift pump 46, during its most recent activation, to a predefined magnitude. This is represented by functional block 112. It should be recognized that the lift pump 46 is not operated continually according to the present invention. Instead, it is operated during periods when the engine control unit 40 has activated the lift pump 46 to perform the filling operation represented by functional block 104. The current level during the most recent usage of the pump 46 is stored and interrogated at functional block 112. Alternatively, the current magnitude drawn by the lift pump 46 could be instantaneously monitored during the filling step represented by functional block 104. The precise chronology of this interrogation and performance of functional block 112 is not limiting to the present invention. If the current of pump 46 is lower than the predefined threshold magnitude, a low fuel warning is provided as represented by functional block 116 so that the operator of the marine vessel is aware that the fuel in remote tank 50 is low. The low current drawn by lift pump 46 is generally indicative of the absence of liquid in the fuel line between the remote tank 50 and the lift pump 46. It should also be understood that the interrogation relating to functional block 112 and the low fuel warning related to functional block 116 are not necessary in all embodiments of the present invention. After performing functional block 112, the algorithm proceeds again to node B and the accumulation of fuel injection usage is continued. During most periods of operation, the algorithm continually performs the steps represented by functional blocks 108, 110, and 112 until the fuel usage equals or exceeds that represented by arrow M in FIG. 2. At that point, the tank 10 is filled, as described in functional block 104, and then the algorithm shown in FIG. 3 continues to perform the steps represented by functional blocks 108, 110, and 112.

With reference to FIGS. 2 and 3, it is important to note that the present invention uses only one sensor 24 to indicate the fuel level in the tank 10 to be at that represented by line 30. It does not use any other sensors to monitor or measure the level of fuel 12 within the tank 10. Instead, it indirectly determines the fuel 12 to be at level 34 by accumulating the actual fuel usage by the engine. In this way, the present invention provides a simplified scheme to maintain the appropriate level of fuel 12 within tank 10 and activates the lift pump 46 only under two circumstances. First, with the fuel consumption exceeds that represented by arrow M in FIG. 2 subsequent to the most recent filling of the tank 10, the pump 46 is activated until the level again reaches that represented by dashed line 30. Secondly, upon initial starting of the engine, the fuel pump 46 is activated to assure that the fuel level reaches that represented by dashed line 30 so that all monitoring of consumed fuel is accurately referenced to that level.

Although the present invention has been described with particular specificity and illustrated to show a preferred embodiment, it should be understood that alternative embodiments are also within its scope.

What is claimed is:

1. A method for controlling the level of a liquid in a tank, comprising:

providing a liquid level sensor which provides a signal when said liquid is at a first predefined level within said tank;

measuring a quantity of said liquid removed from said tank subsequent to said liquid level sensor providing said signal that said liquid was at said first predefined level, said quantity measuring step comprising the step of accumulating the total volume of said liquid injected by a fuel injector since the last occurrence of said signal;

comparing said quantity to a predefined magnitude;

causing a flow of said liquid into said tank from an external source when said quantity equals or exceeds said predefined magnitude; and terminating said causing step when said liquid level sensor provides said signal when said liquid is at said first predefined level.

2. The method of claim 1, wherein:

said liquid is fuel.

3. The method of claim 1, wherein:

said tank is a vapor separator tank.

4. The method of claim 1, wherein:

said tank is disposed under a cowl of an outboard motor.

5. The method of claim 1, wherein:

said signal is a binary signal.

6. The method of claim 1, wherein:

said quantity measuring step comprises the step of counting a number of fuel injection operations that have occurred since the last occurrence of said signal.

7. The method of claim 1, further comprising the step of:

filling said tank from an external source when an ignition system is initially operated after a period of inactivity.

8. The method of claim 1, further comprising:

measuring a usage of electrical current by a pump used to perform said causing step; and transmitting an alarm signal when said usage of electrical current falls below a predefined magnitude while said pump is operating.

9. A method for controlling the level of a liquid fuel in a tank, comprising:

providing a liquid level sensor which provides a binary signal when said liquid fuel is at a first predefined level within said tank;

measuring a quantity of said liquid fuel removed from said tank subsequent to said liquid level sensor providing said signal that said liquid fuel was at said first predefined level, said quantity measuring step comprising the step of counting a number of fuel injection operations that have occurred since the last occurrence of said signal;

comparing said quantity to a predefined magnitude;

causing a flow of said liquid fuel into said tank from an external source when said quantity equals or exceeds said predefined magnitude; and terminating said causing step when said liquid level sensor provides said signal when said liquid fuel is at said first predefined level.

10. The method of claim 9, wherein:

said tank is a vapor separator tank.

11. The method of claim 10, wherein:

said tank is disposed under a cowl of an outboard motor.

12. The method of claim 11, wherein:

said quantity measuring step comprises the step of accumulating the total volume of said liquid fuel injected by a fuel injector since the last occurrence of said signal.

13. The method of claim 12, further comprising the step of:

filling said tank from an external source when an ignition system is initially operated after a period of inactivity.

14. The method of claim 13, further comprising:

measuring a usage of electrical current by a pump used to perform said causing step; and transmitting an alarm signal when said usage of electrical current falls below a predefined magnitude while said pump is operating.

15. A method for controlling the level of a liquid fuel in a vapor separator tank of a marine propulsion device, comprising:

providing a liquid level sensor which provides a binary signal when said liquid fuel is at a first predefined level within said vapor separator tank;

measuring a quantity of said liquid fuel removed from said vapor separator tank subsequent to said liquid level sensor providing said signal that said liquid fuel was at said first predefined level;

comparing said quantity to a predefined magnitude;

causing a flow of said liquid fuel into said vapor separator tank from an external source when said quantity equals or exceeds said predefined magnitude;

terminating said causing step when said liquid level sensor provides said signal when said liquid fuel is at said first predefined level;

filling said vapor separator tank from an external source when an ignition system is initially operated after a period of inactivity;

measuring a usage of electrical current by a pump used to perform said causing step; and transmitting an alarm signal when said usage of electrical current falls below a predefined magnitude while said pump is operating.

16. The method of claim 15, wherein:

said vapor separator tank is disposed under a cowl of an outboard motor.

17. The method of claim 16, wherein:

said quantity measuring step comprises the step of accumulating the total volume of said liquid fuel injected by a fuel injector since the last occurrence of said signal.

* * * * *